US005421039A

United States Patent [19]

Hirashiba et al.

[11] Patent Number: 5,421,039

[45] Date of Patent: Jun. 6, 1995

[54] SANITARY DEVICE HAVING WARM WATER TANK

[75] Inventors: Yuji Hirashiba; Osamu Matsubara, both of Anjo; Kouichi Hayashi; Shinji Kawai, both of Toyota, all of Japan

[73] Assignee: Aisin Seiki Kabushiki Kaisha, Kariya, Japan

[21] Appl. No.: 766,223

[22] Filed: Sep. 27, 1991

[30] Foreign Application Priority Data

Sep. 29, 1990 [JP] Japan ..... 2-261993

[51] Int. Cl.[6] ..... E03D 9/08

[52] U.S. Cl. ..... 4/420.2; 4/443

[58] Field of Search ..... 4/420.1, 420.2, 420.3, 4/420.4, 443, 444, 445, 446

[56] References Cited

U.S. PATENT DOCUMENTS

| | | | |
|---|---|---|---|
| 4,062,071 | 12/1977 | Blanquet | 4/420.2 X |
| 4,123,807 | 11/1978 | Oguma et al. | 4/420.2 X |
| 4,208,746 | 6/1980 | Minamoto et al. | 4/420.2 X |
| 4,304,016 | 12/1981 | Oguma et al. | 4/420.2 |
| 4,559,651 | 12/1985 | Tanahashi et al. | 4/420.2 X |
| 4,581,779 | 4/1986 | Matsui et al. | 4/420.2 |
| 4,841,582 | 6/1989 | Matsui et al. | 4/420.3 X |

FOREIGN PATENT DOCUMENTS

| | | | |
|---|---|---|---|
| 64-57174 | 4/1989 | Japan . | |
| 0318625 | 12/1989 | Japan | 4/420.2 |
| 0144430 | 6/1990 | Japan | 4/420.4 |
| 0217534 | 8/1990 | Japan | 4/420.2 |

*Primary Examiner*—William A. Cuchlinski, Jr.
*Assistant Examiner*—John L. Beres
*Attorney, Agent, or Firm*—Oblon, Spivak, McClelland, Maier, & Neustadt

[57] ABSTRACT

A warm water tank in a sanitary device for a toilet bowl has a tank portion. A heater disposed in the tank portion so as to be located at a side portion of the toilet bowl. A water supply pipe is disposed in the tank portion so as to be located at the side portion of the toilet bowl. A water storing chamber formed in the tank portion so as to be located at a upper portion of the toilet bowl.

5 Claims, 4 Drawing Sheets

SANITARY DEVICE HAVING WARM WATER TANK

BACKGROUND OF THE INVENTION

1. Field of the Invention

This invention relates to a warm water tank for a sanitary device, and more particularly to a sanitary device including a nozzle means which is operated by water under pressure.

2. Description of the Prior Art

In a sanitary device which has a function for washing a human private part such as an anus or a pubic portion (bidet portion), to ensure comfort during washing, the human private part is washed by warm water which is supplied from a warm water tank. The warm water tank for the sanitary device is disclosed in Japanese Utility Hodel Laid-open No. 64(1989)-57174 (shown in FIG. 4).

The warm water tank includes a tank portion 7' which is formed with a water storing chamber 8' for storing water, a heater 11' which is accommodated in the tank portion 7' for heating the water, a water supply pipe 9' through which the water is supplied to the water storing chamber 8' from the outside, a spraying nozzle 50' from which the warm water is injected to the human private part and a warm water supplying portion 13' for supplying the warm water to the spraying nozzle 50' from the water storing chamber 8'. An opening end 9a' of the supply pipe 9' is disposed near a bottom surface of the tank portion 7'. The water storing chamber 8' is connected to the warm water supplying portion 13' through a warm water supplying pipe 72d' which has a warm water inlet hole 72c' that is opened at an upper portion of the water storing chamber 8'. The water which is stocked in the water storing chamber 8' of the warm water tank becomes the warm water by the heating of the heater 11'. The warm water is fed into the warm water supplying pipe 72d' from the warm water inlet hole 72c' of the warm water pipe 72d' and is injected to the human private part from tile spraying nozzle 50' through the warm water supplying portion 13' after the water is pressurized in the water storing chamber 8' by city water pressure or a pump.

The heater 11' which is disposed in the water storing chamber 8' of the tank portion 7' has a horizontal calorific portion 11a' and a perpendicular calorific portion 11b'. The horizontal calorific portion 11a' is established in the tank portion 7' so as to leave a certain degree of a space from the bottom surface of the tank portion 7'. A basin of the warm water which is kept at a proper temperature by the heater 11' in the water storing chamber 8' is above the horizontal calorific portion 11a' of the heater 11', due to a convection property of the heating water. Therefore, the temperature of water below the horizontal calorific portion 11a' becomes lower than the proper temperature, and the overall temperature of the water is reduced so that warm water is not pervaded in the water storing chamber 8'. Therefore, the warm water tank has a drawback that a time during which the proper temperature water is injected to the human private part from the spraying nozzle 50' is short.

OBJECT AND SUMMARY OF THE PRESENT INVENTION

It is an object of the present invention to provide a warm water tank for a sanitary device extending a time during which the proper temperature water is injected from the spraying nozzle.

In order to accomplish the object, the present invention provides a warm water tank including of a toilet bowl and a tank portion. A heater is disposed in the tank portion so as to be located at a side portion of the toilet bowl. A water supply pipe is disposed in the tank portion so as to be located at the side portion of the toilet bowl. A water storing chamber is formed in said tank portion so as to be located at a upper portion of the toilet bowl.

BRIEF DESCRIPTION OF THE DRAWINGS

These and other objects, features and advantages of the present invention will become more apparent on reading the following detailed description with reference to the accompanying drawings, wherein like members bear like reference numerals, and wherein.

DETAILED DESCRIPTION OF THE PREFERRED EMBODIMENT

Figure 2:
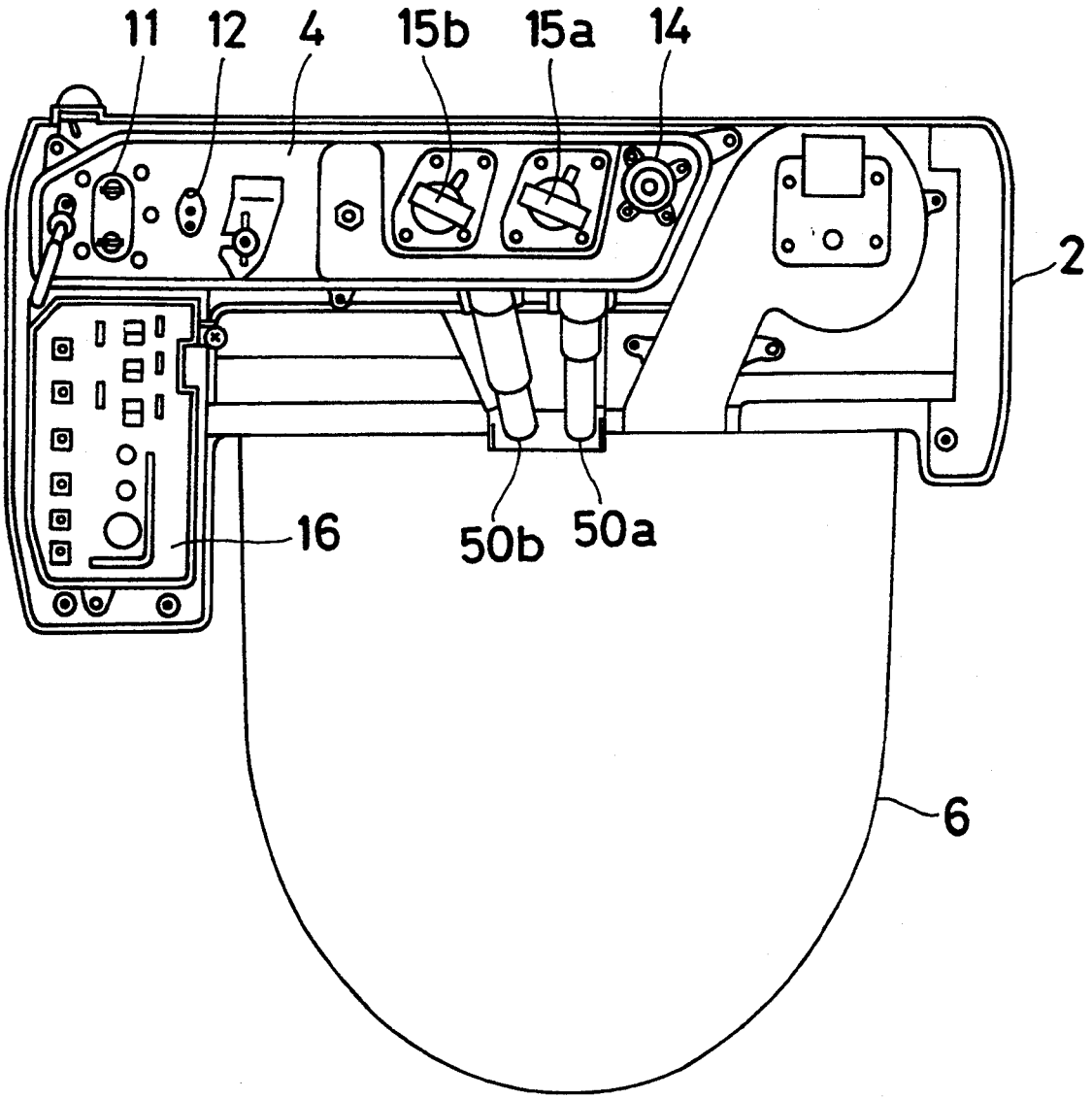
FIG. 2 is a plan view of a warm water tank for a sanitary device according to the present invention.
Figure 3:
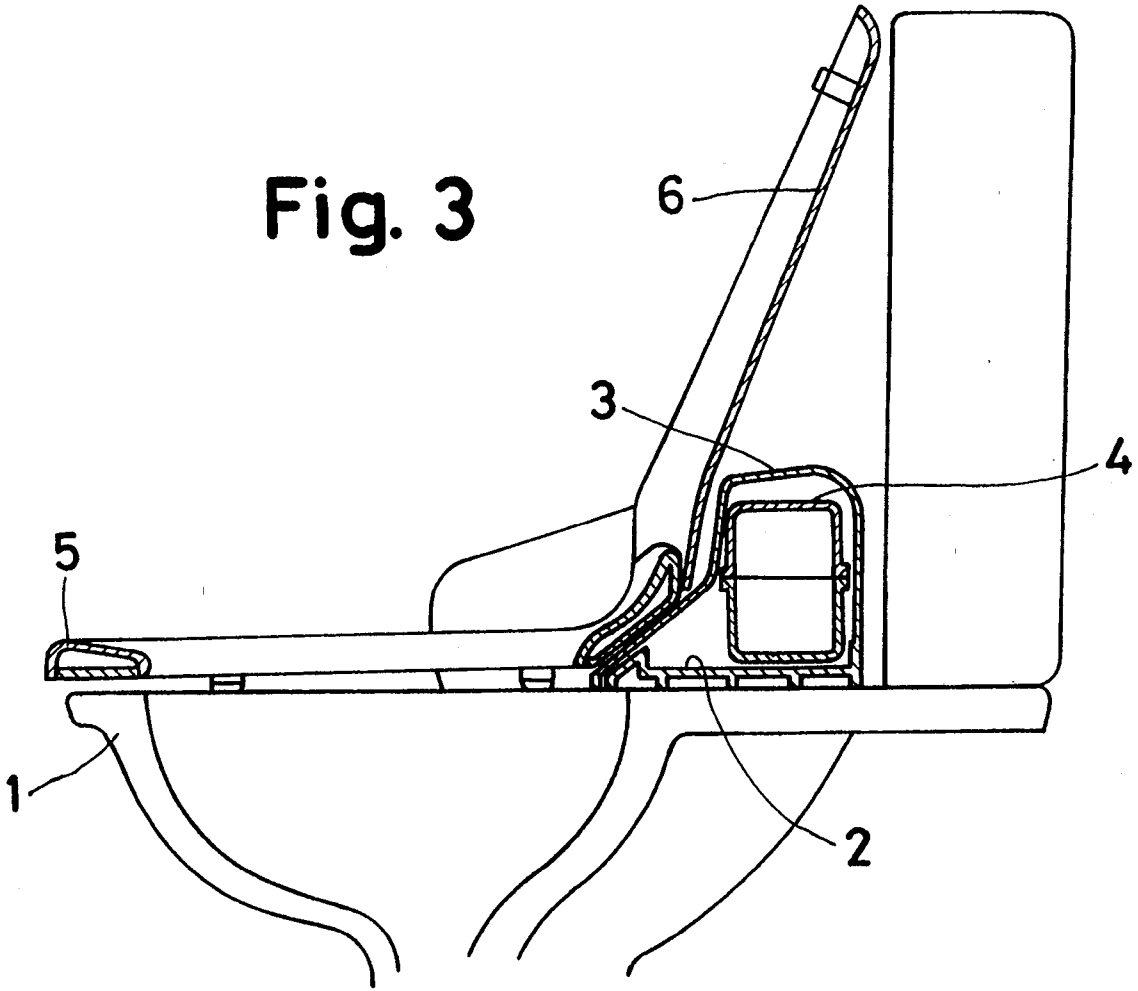
FIG. 3 is a side view of a warm water tank for a sanitary device according to the present invention.
Figure 4:
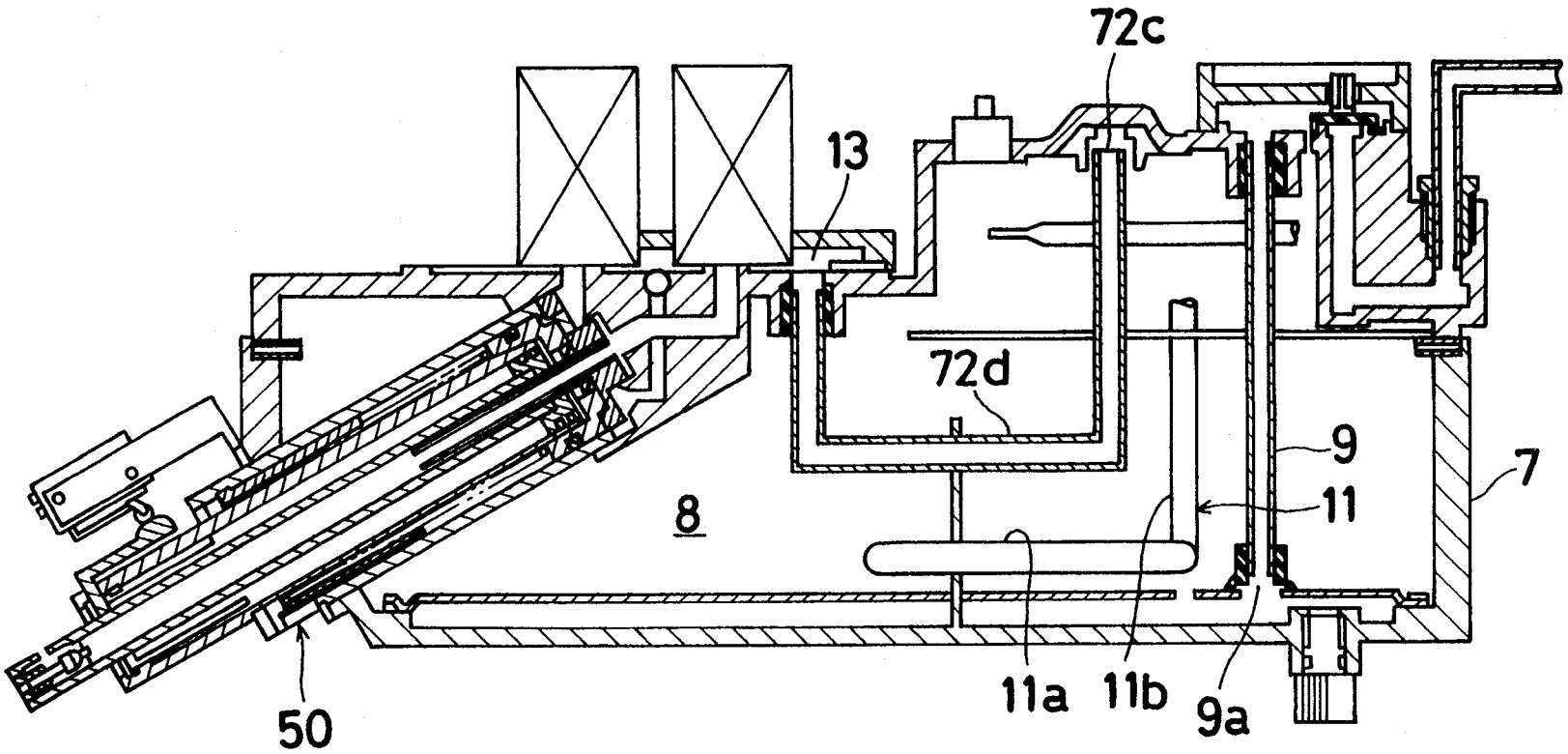
Fig. 4 (PRIOR ART)
FIG. 4 is a sectional view of a warm water tank for a sanitary device according to the Prior Art.

An embodiment of the present invention will be described hereinafter with reference to FIGS. 1 to 3 inclusive. As shown in FIG. 3, a sanitary device includes a toilet bowl 1, a plate 2 which is located at an upper portion and a side portion of a rearward end of the toilet bowl 1, a case 3 which is unitedly connected to the plate 2 in such a manner that an inner space is formed between the plate 2 and the case 3, a warm water tank 4 which is disposed in the inner space, a lavatory seat 5 and a cover 6 both of which are rotatably supported to the case 3 through a common hinge (not shown).

Figure 1:
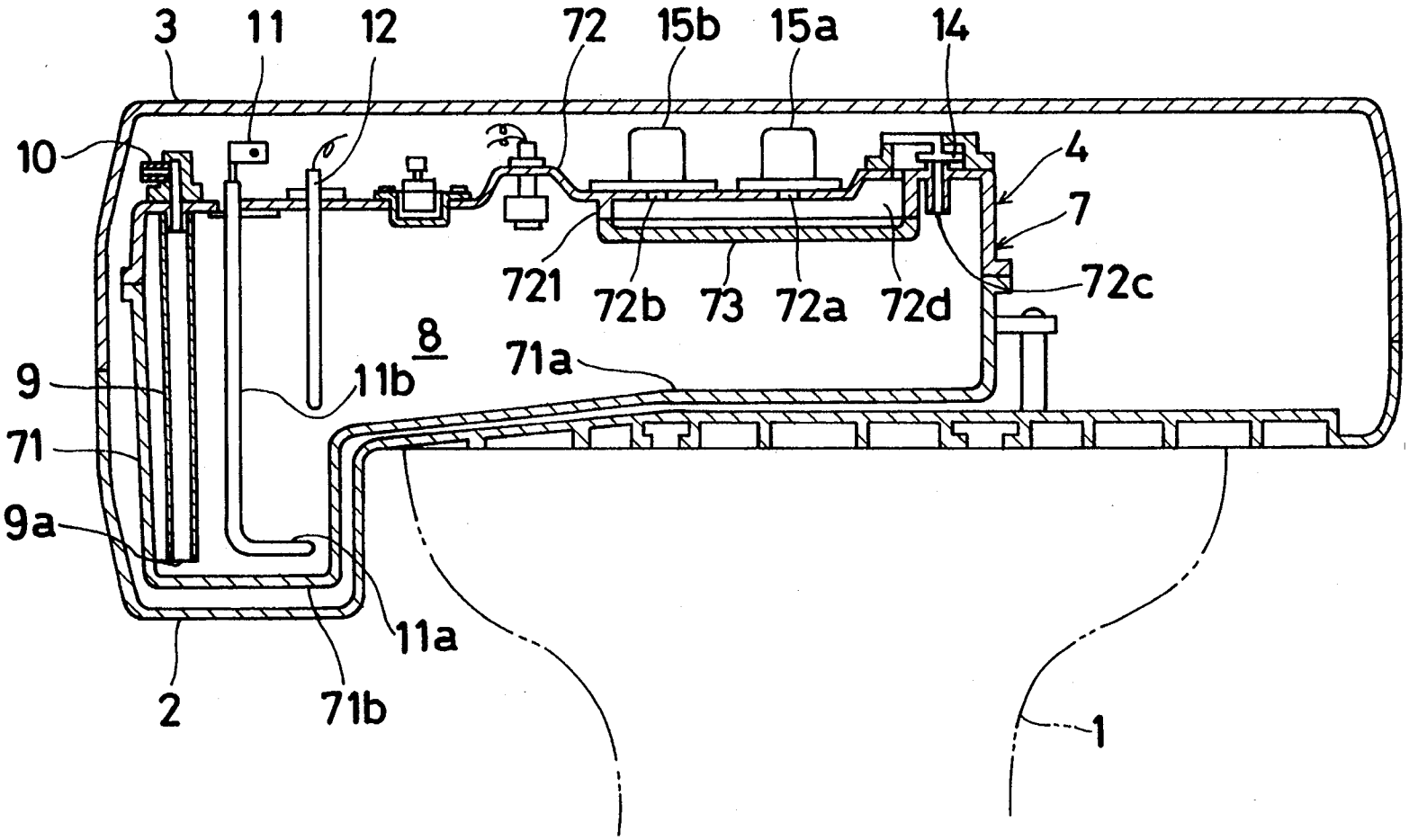
FIG. 1 is a sectional view of a warm water tank for a sanitary device according to the present invention.

As shown in FIG. 1, the warm water tank 4 includes a tank portion 7 which includes a lower tank portion 71 and an upper tank portion 72, and a water storing chamber 8 as a sealed space is formed in the tank portion 7. The lower tank portion 71 includes a bottom portion. The bottom portion includes a broad shallow portion 71a which is located on the upper portion of the toilet bowl 1 and a narrow deep portion 71b which is located at the side of the toilet bowl 1. The portion 71b is smaller and larger in width, respectively, then the broad shallow portion 71a.

A supply pipe 9 is fixed to the upper tank portion 72. An opening point 9a of the supply pipe 9 is disposed near the bottom of the narrow deep portion 71b. The supply pipe 9 is connected to the city water pressure or conncting pipe 10 of a hydraulic pump (not shown) through a switching valve. Further, a heater 11 is fixed to the upper tank portion 72. The heater 11 has a horizontal calorific portion 11a which is disposed on near the bottom of the narrow deep portion 71b and a perpendicular calorific portion 11b which is continuously extended from the horizontal calorific portion 11a. A thermostat 12 which is set to detect a temperature of water for the control of the electricity to be transmitted to the heater 11, is fixed to the upper tank portion 72. The thermostat 12 is located near a bottom of the broad shallow portion 71a.

Warm water outlet holes 72*a*, 72*b* and a warm water inlet hole 72*c* are formed at the the upper tank portion 72. The warm water outlet holes 72*a*, 72*b* are connected to spraying nozzles 50*a*, 50*b* (shown FIG. 2) through a warm water supplying portion (not shown). The spraying nozzle 50*a* for washing an anus of a human and the spraying nozzle 50*b* for washing pubic portion or a bidet portion of a female. And, a warm water passage 72*d* which is connected between the warm water outlet holes 72*a*, 72*b* and the warm water inlet hole 72*c* is formed by an inner cover 73 which is applied at an expanded portion 721 which is projected from an inner surface of the upper tank portion 72. A vacuum breaker 14 is disposed in the warm water inlet hole 72*c*. Further, 3-way electromagnetic valves 15*a*, 15*b* are disposed in the warm water supplying portion. The electromagnetic valves 15*a*, 15*b* supply warm water in the warm water passage 72*d* selectively to the spraying nozzle 50*a*, 50*b*.

The sanitary device is used as follows;

A main electromagnetic valve (not shown) is operated by switching a control member 16. The pressurized water is sent through the conncting pipe 10 and supply pipe 9 and flowing into the stored water chamber 8 from the opening point 9*a* of the supply pipe 9. The warm water which is stored in the water storing chamber 8 and which is heated by the heater 11 flows in the warm water passage 72*d* via the warm water inlet hole 72*c*, due to hydraulic pressure. And, the warm water which sent through the warm water passage 72*d* is sent to the spraying nozzle 50*a* or spraying nozzle 50*b* by action of the electro magnetic valve 15*a*, 15*b* and injected in the human private part.

In this embodiment, since the horizontal calorific portion 11*a* of the heater 11 is so located in the narrow deep portion 71*b* as to be near the bottom portion thereof, the volume of the water above the calorific portion 11*a* becomes greater than the volume of the water heated in the conventional tank. Further, the opening point 9*a* of the supply pipe 9 is disposed in the narrow deep portion 71*b*. Therefore, all the warm water which is upward of the opening point 9*a* is sent to the supplied warm water portion by the hydraulic pressure of the water which is supplied from the opening point 9*a*.

Therefore, a time during which the proper temperature water is injected from the spraying nozzles 50*a*, 50*b* can be extended.

Further, the warm water passage 72*d* which is connected between the warm water outlet holes 72*a*, 72*b* and the warm water inlet hole 72*c* is formed by the inner cover 73 which is applied at the inner surface of the upper tank portion 72. Therefore, a space which is limited by the form of the warm water passage 72*d* in the water storing chamber 8 is reduced. Therefore, a space in the stored water chamber 8 can be effective used.

The principles, preferred embodiments and modes of operation of the present invention have been described in the foregoing application. The invention which is intended to be protected herein should not, however, be construed as limited to the particular forms disclosed, as these are to be regarded as illustrative rather then restrictive. Variations and changes maybe made by those skilled in the art without departing from the spirit of the present invention. Accordingly, the foregoing detailed description should be considered exemplary in nature and not limited to the scope and spirit of the invention as set forth in the appended claims.

What is claimed is:

1. A sanitary device for a toilet bowl comprising:

a warm water tank including a tank portion defining a water storing chamber positioned in proximity to the toilet bowl;

a heater disposed in the tank portion;

a water supply pipe disposed in the tank portion for supplying water to be heated by the heater;

at least one spray nozzle positioned for spraying water into the toilet bowl; and a valve openable to supply warm water from the tank portion to the nozzle, wherein said tank portion includes a broad shallow portion, and a narrow deep portion at one side of the tank portion, and wherein said heater extends into said narrow deep portion and an outlet of said water supply pipe is in said narrow deep portion.

2. The device of claim 1 including a warm water passage in the tank portion and connecting an end of the water storing chamber opposite the one side having the narrow deep portion to the valve.

3. The device of claim 1 including a thermostatic temperature detector positioned in said tank portion.

4. The device of claim 1 including two of said nozzles and two of said valves.

5. The device of claim 4 wherein said valves are electromagnetic valves.

* * * * *